US012240023B2

(12) United States Patent
Gorgels et al.

(10) Patent No.: US 12,240,023 B2
(45) Date of Patent: Mar. 4, 2025

(54) FLATNESS-MEASURING DEVICE, HOT-ROLLING MILL AND METHOD FOR OPERATING A FLATNESS-MEASURING DEVICE

(71) Applicant: SMS group GmbH, Düsseldorf (DE)

(72) Inventors: Frank Gorgels, Aachen (DE); Olaf Norman Jepsen, Siegen (DE); Patrick Siemann, Kreuztal (DE); Andreas Kastner, Kirchhundem (DE)

(73) Assignee: SMS group GmbH, Düsseldorf (DE)

( * ) Notice: Subject to any disclaimer, the term of this patent is extended or adjusted under 35 U.S.C. 154(b) by 193 days.

(21) Appl. No.: 18/023,582

(22) PCT Filed: Aug. 12, 2021

(86) PCT No.: PCT/EP2021/072441
§ 371 (c)(1),
(2) Date: Feb. 27, 2023

(87) PCT Pub. No.: WO2022/043069
PCT Pub. Date: Mar. 3, 2022

(65) Prior Publication Data

US 2023/0311182 A1 Oct. 5, 2023

(30) Foreign Application Priority Data

Aug. 31, 2020 (DE) ..... 10 2020 210 970.2

(51) Int. Cl.
*B21B 38/02* (2006.01)
*B21B 37/68* (2006.01)

(52) U.S. Cl.
CPC ..... *B21B 38/02* (2013.01); *B21B 37/68* (2013.01); *B21B 2273/04* (2013.01)

(58) Field of Classification Search
CPC ..... B21B 38/02; B21B 37/28; B21B 37/68; B21B 37/04
See application file for complete search history.

(56) References Cited

U.S. PATENT DOCUMENTS 4,809,528 A 3/1989 Lawson et al.
5,509,285 A 4/1996 Anbe
(Continued)

FOREIGN PATENT DOCUMENTS

DE 4224569 A1 1/1993
DE 3782125 2/1993
(Continued)

OTHER PUBLICATIONS

Anonymous, EMG: Strip guiding systems for safe production processes, Strip guiding solutions, retrieved from https://www.emg.elexis.group/en/metal/strip-guiding-solutions on Feb. 13, 2023.

*Primary Examiner* — Mohammed S. Alawadi
(74) *Attorney, Agent, or Firm* — Smartpat PLC

(57) ABSTRACT

A flatness-measuring device for a hot-rolled strip within a hot-rolling mill includes an entry-side deflection roller and an exit-side deflection roller. A central deflection roller is arranged between the entry-side deflection roller and the exit-side deflection roller. The central deflection roller is used as a flatness-measuring roller. To prevent the hot-rolled strip from departing laterally during a flatness measurement, the flatness-measuring device has a sensing apparatus for sensing an actual position of the hot-rolled strip. An adjusting apparatus is connected to the sensing apparatus and to at least one of the deflection rollers. The flatness-measuring device is designed to vary an angle between a longitudinal central axis of the deflection roller respectively connected to the adjusting apparatus and a longitudinal axis of the flatness-measuring device based on a deviation of the actual
(Continued)

position of the hot-rolled strip from a predefined target position.

15 Claims, 2 Drawing Sheets

(56) References Cited

U.S. PATENT DOCUMENTS

| | | | | |
|---|---|---|---|---|
| 5,778,717 | A * | 7/1998 | Berger | B21B 37/68 72/8.7 |
| 6,128,937 | A * | 10/2000 | Seidel | B21B 1/26 72/201 |
| 9,889,480 | B2 | 2/2018 | Nelson et al. | |
| 2005/0056067 | A1 * | 3/2005 | Clark | B21B 1/24 72/160 |
| 2016/0332203 | A1 | 11/2016 | Ueno et al. | |

FOREIGN PATENT DOCUMENTS

| | | | |
|---|---|---|---|
| DE | 19524729 | A1 | 1/1997 |
| EP | 0906797 | B1 | 4/2004 |
| EP | 3097990 | B1 | 12/2018 |
| JP | H07256327 | A | 10/1995 |
| JP | 2012206132 | A | 10/2012 |

* cited by examiner

FLATNESS-MEASURING DEVICE, HOT-ROLLING MILL AND METHOD FOR OPERATING A FLATNESS-MEASURING DEVICE

TECHNICAL FIELD

The disclosure relates to a flatness-measuring device for measuring the flatness of a hot-rolled strip within a hot-rolling mill, to a hot-rolling mill having at least one flatness-measuring device, and to a method for operating a flatness-measuring device for measuring the flatness of a hot-rolled strip within a hot-rolling mill.

BACKGROUND

If a metal strip is guided over a longer distance in a mill, it is of particular importance that methods and/or devices that allow the strip run of the metal strip to be controlled are available. Such methods and/or devices influence the strip run in such a manner that lateral departure of the metal strip is prevented. If lateral departure were not prevented, the metal strip would hit lateral boundaries of the mill and be damaged. In the worst case, this leads to a disruption of the process up to a strip rupture, which in such an often continuous process is to be regarded as a serious accident, which incurs considerable costs.

With a flatness measurement in a hot-rolling mill for steel, a possible position for the measuring device used for this purpose is between the cooling section and a driver roll of the hot-rolling mill. Since flatness measurement requires a wrap around flatness-measuring roller, which deflects the metal strip in the process and can thus also be referred to as a deflection roller in the sense of the present disclosure, the measuring roller must be immersed in the metal strip. As soon as the measuring roller is immersed in the metal strip, a configuration of three deflection rollers is created, specifically an entry-side roller as a deflection roller, the measuring roller as a deflection roller and the exit-side roller as a deflection roller.

This configuration leads to a great risk of strip departure. In particular, metal strips with low strip thickness tend to be unstable in the lateral direction. In such cases, flatness measurement by means of a measuring roller is practically no longer possible. The wear on lateral guides of the mill is considerably increased, the winding quality of strip coils is significantly deteriorated and the risk of cobbles or strip ruptures, as the case may be, is increased. The lateral departure of the metal strip also creates a stress distortion that causes a disruption in the flatness measurement. Such disruption makes it impossible to measure a linear flatness error.

From continuous processes for the treatment of metal strips, such as in continuous annealing furnaces and galvanizing lines, as the case may be, convex deflection rollers and deflection rollers mounted on pivot frames are known. The convex deflection rollers lead to a centering effect due to the redistribution of tensile stresses generated by the camber. The pivot frames are controlled by a closed-loop control based on a measured strip center position. When cold rolling longitudinally split hot-rolled strip, the problem arises that, due to the conical coil structure, the hot-rolled strip also shows a strong tendency to depart laterally. Such disruption of the rolling process is countered by pivoting the deflection roller arranged directly in front of a coiler. This measure can bring the strip back into a centered strip run.

When using these known methods, it is assumed that the strips are permanently under strip tension. The completely different clamping situation in hot rolling has long stretches where the strip is subject to guidance with little or no strip tension. Such clamping situation, compared to a deflection roller commonly used in cold rolling, requires devices and methods that can control the strip in the case of a triple deflection. In addition, due to the much longer clamping lengths between the last roll stand and the flatness-measuring roller, and the associated large dead time, conventional control methods fail.

Strip run control upon the coiling and decoiling of metal strip and in continuous lines on the basis of optical strip center measurement are generally known. However, the means used for this purpose are not applicable for use in a roller table of a hot-rolling mill. In addition, such means also have no possibility of compensating for a disruption of a flatness measurement.

JP 2012 206 132 A discloses a rolling mill having rolls that roll a rolling material, a winding roller that is arranged downstream of the rolls and winds the rolled material, and a deflecting roller that changes an advancing direction of the rolling material that has been rolled by the rolls to guide it to the winding roller. When carrying out rolling using the rolling mill, the state of a surface defect that has been created in the rolling material wound on the winding roller is sensed. One end of the deflection roller is moved in a direction perpendicular to the central axis of the deflection roller based on the sensed state of the surface defect, such that the generation of the surface defect can be suppressed.

EP 3 097 990 A1 discloses a cold rolling device that heats a sequentially transferred steel sheet by using a heating device and sequentially cold rolls the steel sheet after heating by using a cold rolling mill. The cold rolling device has a meandering movement correction device that is arranged on an upstream side of the heating device in a transfer direction of the steel sheet and is configured to correct a meandering movement of the steel sheet transferred towards the heating device. In addition, the cold rolling device has a meandering movement suppression device that is arranged between the heating device and the cold rolling mill and is configured to suppress the meandering movement of the steel sheet associated with cold rolling of the steel sheet through the use of the cold rolling mill. Further, the cold rolling device has a controller that is configured to control the meandering movement correction device to carry out a meandering movement correction operation, in order to correct the meandering movement of the steel sheet transferred towards the heating device. In addition, the controller is designed to control the meandering movement suppression device to carry out a meandering movement suppression operation, in order to suppress the meandering movement of the steel sheet associated with the cold rolling of the steel sheet. The controller controls the meander movement suppression device to carry out the meander movement suppression operation in a timing when the controller controls the meander movement correction device, in order to carry out the meander movement correction operation.

DE 195 24 729 A1 discloses a device for rolling strips that have a non-uniform thickness and/or length distribution over their width. The device has at least one control roller that is arranged on the entry side and/or exit side of the rolling mill and is pivotable in its position relative to the strip, means for sensing the distribution of tensile stress over the width of the strip, and a control device that uses the sensed distribution of tensile stress to determine actuating signals for actuating devices for pivoting the control roller.

SUMMARY

One object of the invention is to prevent a hot-rolled strip from departing laterally in a hot-rolling mill during a flatness measurement on the hot-rolled strip.

This object is achieved by the independent patent claims. Advantageous embodiments are reproduced in the following description, the dependent patent claims and the figures, wherein these embodiments can each in themselves or in combination of at least two of such embodiments with one another represent a further developing, in particular also preferred or advantageous aspect of the invention. Thereby, designs of the flatness-measuring device may correspond to designs of the method, and vice versa, even if this is not explicitly referred to in individual cases in the following.

A flatness-measuring device for measuring the flatness of a hot-rolled strip within a hot-rolling mill has at least one entry-side deflection roller for contacting a first large side of the hot-rolled strip, at least one exit-side deflection roller for contacting the first large side of the hot-rolled strip, at least one deflection roller, which is arranged between the entry-side deflection roller and the exit-side deflection roller with respect to a strip running direction of the hot-rolled strip and can be placed against a second large side of the hot-rolled strip opposite from the first large side of the hot-rolled strip, and is used as a flatness-measuring roller, at least one sensing apparatus for sensing an actual position of the hot-rolled strip, and at least one adjusting apparatus, which is connected to the sensing apparatus and to at least one of the deflection rollers, and is designed to vary an angle between a longitudinal central axis of the deflection roller respectively connected to the adjusting apparatus and a longitudinal axis of the flatness-measuring device running transversely to the deflection rollers in accordance with a deviation of the actual position of the hot-rolled strip from a predefined target position of the hot-rolled strip.

The sensing apparatus for sensing an actual position of the hot-rolled strip can be located close to the central deflection roller. In particular, the sensing apparatus for sensing an actual position of the hot-rolled strip can be arranged upstream or downstream of the central deflection roller. Preferably, the sensing apparatus for sensing an actual position of the hot-rolled strip is arranged directly at the central deflection roller. Preferably, the sensing apparatus for sensing an actual position of the hot-rolled strip is located no further than 1 m away from the central deflection roller. The sensing apparatus can be designed to determine the position of the hot-rolled strip from measured values of the flatness measurement and/or from tension measurement signals of load cells arranged under bearings of one of the deflection rollers.

Due to a long clamped length of hot-rolled strip between a flatness-measuring device and a finishing line of a hot-rolling mill, the strip run becomes highly unstable when the central deflection roller used as a flatness-measuring roller is immersed, such that the hot-rolled strip could easily depart laterally. This can be reliably prevented with the flatness-measuring device by influencing or correcting, as the case may be, the strip run by varying the angle between the longitudinal central axis of the respective deflection roller connected to the adjusting apparatus and the longitudinal axis of the flatness-measuring device in accordance with the momentary deviation of the actual position of the hot-rolled strip from a predefined target position of the hot-rolled strip.

The application of the invention makes it possible in particular to control the strip center position upon the flatness measurement in the exit roller table of a hot-rolling mill. Without the invention, the hot-rolled strips would depart so much laterally during the flatness measurement process that the process would have to be aborted. This problem occurs particularly in the case of hot-rolled strip with low strip thickness. However, such hot-rolled strips are particularly interesting for flatness measurement.

Upon the flatness measurement, for example, a distribution of tensile stress in the hot-rolled strip can be measured.

The entry-side deflection roller for contacting the first large side, for example the lower side, i.e. the lower broadside, of the hot-rolled strip can in particular be a roller of a roller table via which the rolled hot-rolled strip can be fed to the flatness-measuring device. Conversely, therefore, the term "upper broadside" means the opposite large side, i.e. the upper broadside, of the hot-rolled strip.

The exit-side deflection roller for contacting the first large side, for example the lower side, of the hot-rolled strip can in particular be a roller table roller of a roller table, via which the hot-rolled strip measured with the flatness-measuring device can be fed to a driving roller unit of the hot-rolling mill upstream of a coiler of the hot-rolling mill.

The center deflection roller is used as a flatness-measuring roller. In particular, in a top view of one of the large sides of the hot-rolled strip with respect to the strip running direction of the hot-rolled strip, the central deflection roller is arranged between the entry-side deflection roller and the exit-side deflection roller. In order to be able to carry out a flatness measurement, the central deflection roller can be placed against the second large side of the hot-rolled strip opposite from the first large side, for example the top side. For this purpose, the central deflection roller is connected to an actuator system for placing the central deflection roller and to evaluation electronics for evaluating mechanical loads on the center deflection roller.

The sensing apparatus for sensing the actual position of the hot-rolled strip can, for example, have at least one optical sensor, for example a camera. In addition, the sensing apparatus can have evaluation electronics for processing signals from the optical sensor. The sensing apparatus can, for example, be designed to sense an actual position of a strip center of the hot-rolled strip as the entry-side actual position of the hot-rolled strip.

The adjusting apparatus can, for example, be connected solely to the entry-side deflection roller, in order to be able to vary the position of such deflection roller, by which the open-loop or closed-loop control of the actual position or center position of the hot-rolled strip, as the case may be, can be effected. By means of the adjusting apparatus, the entry-side deflection roller can be pivoted in a horizontal plane, for example, in order to be able to vary the angle between the longitudinal central axis of the entry-side deflection roller and the longitudinal axis of the flatness-measuring device. The variation of the angle between the longitudinal central axis of the entry-side deflection roller and the longitudinal axis of the flatness-measuring device can correspond to a variation of an angle between the longitudinal central axis of the deflection roller and a longitudinal axis of the hot-rolling mill, wherein the longitudinal axis of the hot-rolling mill is defined by two points, specifically the center of a rolling gap of the last roll stand of the finishing line and the center of a clamping gap of the driving roller assembly in front of the coiler. The angle between the longitudinal central axis of the entry-side deflection roller and the longitudinal axis of the flatness-measuring device can, for example, be in a range of +/−10 mm/m, preferably in a range of +/−15 mm/m, particularly preferably in a range of +/−50 mm/m.

Alternatively, the adjusting apparatus can be connected to the exit-side deflection roller or the central deflection roller alone, in order to be able to displace the respective deflection roller for the open-loop or closed-loop control of the strip run. Alternatively, the adjusting apparatus can be connected to two of the deflection rollers or to all of the deflection rollers, in order to be able to displace the deflection rollers for the open-loop or closed-loop control of the strip run. To carry out the displacement of two or more deflection rollers, these may be displaced by means of a common actuator of the adjusting apparatus or with separate or own actuators, as the case may be, of the adjusting apparatus individually.

The angle of the respective displaceable or pivotable, as the case may be, deflection roller that can be varied is present between the longitudinal central axis of the respective deflection roller aligned transversely to the strip running direction and the longitudinal axis of the flatness-measuring device running transversely to the deflection rollers, wherein the longitudinal axis of the flatness-measuring device can be identical to the longitudinal axis of the hot-rolling mill. In particular, the angle can be in a horizontal plane.

The adjusting apparatus can have at least one controller by means of which the angle between the longitudinal central axis of the respective deflection roller and the longitudinal axis of the flatness-measuring device can be varied in accordance with the deviation of the actual position of the hot-rolled strip from the predefined target position of the hot-rolled strip. The controller can have a center controller that is designed to determine a target position for a pivot position of the respective deflection roller from the deviation of the actual position of the hot-rolled strip from the predefined target position of the hot-rolled strip or a corresponding difference between the actual position of the hot-rolled strip and the predefined target position of the hot-rolled strip, through the application of which the strip run of the hot-rolled strip can be corrected. The center controller can be designed as a PI controller.

In accordance with an advantageous embodiment, the adjusting apparatus is designed to determine an actual position of the respective deflection roller connected to the adjusting apparatus, to determine a target position of such deflection roller from the deviation of the actual position of the hot-rolled strip from the predefined target position of the hot-rolled strip and to determine a target adjustment speed value for adjusting the angle between the longitudinal central axis of such deflection roller and the longitudinal axis of the flatness-measuring device in accordance with a deviation of the actual position of such deflection roller from the target position of such deflection roller. This allows the adjustment speed at which the respective deflection roller is pivoted to be rapidly and individually adapted to the current situation with regard to the strip run. For this purpose, the adjusting apparatus can have a pivot controller that is designed to determine an adjustment speed value from the deviation of the actual position of the respective deflection roller connected to the adjusting apparatus from the target position of such deflection roller or a corresponding difference between the actual position of such deflection roller and the target position of such deflection roller, by means of which the strip run of the hot-rolled strip can be corrected. The pivot controller can be designed as a pure P-controller.

In accordance with a further advantageous embodiment, the adjusting apparatus is designed to determine a speed of a lateral movement of the hot-rolled strip and to determine the target adjustment speed value in accordance with the speed of the lateral movement of the hot-rolled strip. For this purpose, the adjusting apparatus can have a differential controller that is designed to determine an additional value for the pivot speed of the deflection roller connected to the adjusting apparatus from the speed of the entry-side lateral movement of the hot-rolled strip, wherein such additional value and the adjustment speed determined by the pivot controller can be added together in order to generate the target adjustment speed value for controlling an actuator of the adjusting apparatus.

In accordance with a further advantageous embodiment, the adjusting apparatus is designed to pivot the respective deflection roller connected to the adjusting apparatus and/or at least one other deflection roller connected to the adjusting apparatus in a plane that is arranged in a manner perpendicular to the longitudinal axis of the flatness-measuring device, and to carry out the pivoting of the respective deflection roller in the plane in accordance with an angular value by which the angle between the longitudinal central axis of the respective deflection roller and the longitudinal axis of the flatness-measuring device can be varied by means of the adjusting apparatus. If, for example, the entry-side deflection roller for strip run control is varied by an angle between the longitudinal central axis of such deflection roller and the longitudinal axis of the flatness-measuring device, the relatively small distance of such deflection roller from the central deflection roller will result in impairments to the flatness measurement due to a change in the geometry of the clamping of the hot-rolled strip in the flatness-measuring device. In order to be able to compensate for such an error, the deflection roller and/or at least one further deflection roller is pivoted or displaced in the plane arranged in a manner perpendicular to the longitudinal axis of the flatness-measuring device, for example vertically, in such a manner that compensation is made for the change in the geometry of the clamping of the hot-rolled strip in the flatness-measuring device.

For this purpose, the adjusting apparatus can be used to determine a length difference $\Delta l$ between the strip edges of the hot-rolled strip based on a pivot amount SB of the deflection roller, the longitudinal central axis of which is varied by an angle between the longitudinal central axis of such deflection roller and the longitudinal axis of the flatness-measuring device. Thereby, the expression $\Delta l = f(SB, \text{Geometry})$ can apply for the length difference $\Delta l$, wherein the length difference $\Delta l$ is a function of the pivot amount SB and the clamping geometry. On the basis of such difference in length, the adjusting apparatus can be used to determine a pivot amount SM of the deflection roller used to compensate for the change in clamping geometry in the vertical direction, which leads to a minimization of the error caused by the horizontal pivot movement of the deflection roller, the longitudinal central axis of which is varied by the angle between the longitudinal central axis of such deflection roller and the longitudinal axis of the flatness-measuring device. Thereby, the expression $SM = f(\Delta l = 0, \text{Geometry})$ can apply for the pivot amount SM, wherein the pivot amount SM is a function of the length difference $\Delta l$ and the clamping geometry. Such pivot amount SM can be transferred and set directly or via a ramp to an actuator of the adjusting apparatus. The calculation of the pivot amount SM can also be effected directly here, wherein $SM = f(SB, \text{Geometry})$ can apply, thus the pivot amount SM can be a function of the pivot amount SB and the clamping geometry. The relationship between the pivot amount SM and the pivot amount SB can be established in such a manner that the clamped length of the hot-rolled strip over the entire flatness-measuring device at an operating-side strip edge is equal to that at the drive side. To improve the online capability or to simplify the use of the compensation in an online system, as the case may be, the calculation of the relationship of the pivot amount SM with the pivot amount SB can be effected offline and the relationship can be stored in the form of a table in the adjusting apparatus. The movement to compensate for the change in geometry of the clamping of the hot-rolled strip in the flatness-measuring device can be carried out using only the entry-side deflection roller, the exit-side deflection roller or the central deflection roller. Alternatively, such compensation can be effected using two of the deflection rollers or with all of the deflection rollers. To carry out the displacement of two or more deflection rollers, these may be displaced by means of a common actuator of the adjusting apparatus or with separate or own actuators individually, as the case may be, of the adjusting apparatus.

In accordance with a further advantageous embodiment, the respective deflection roller connected to the adjusting apparatus is displaceable about an axis of rotation running perpendicularly to an entering strip section of the hot-rolled strip, wherein the axis of rotation is arranged through a center of the respective deflection roller connected to the adjusting apparatus or offset to the longitudinal axis of such deflection roller. In particular, the axis of rotation can be arranged in the center of the respective deflection roller or offset to the operating side or the drive side.

In accordance with a further advantageous embodiment, the adjusting apparatus has at least one electromechanical drive, for example spindle drive, connected to the respective deflection roller connected to the adjusting apparatus, or at least one hydraulic actuating cylinder connected to such deflection roller.

In accordance with a further advantageous embodiment, the flatness-measuring device has at least one holding frame on which the entry-side deflection roller, the exit-side deflection roller and/or the central deflection roller are or is, as the case may be, rotatably mounted, wherein the adjusting apparatus is connected to the respective deflection roller via the holding frame and the holding frame is displaceable together with the deflection roller respectively connected thereto. Two of the deflection rollers or all of the deflection rollers can also be mounted on the holding frame, in order to be able to move such deflection rollers together to optimize the flatness measurement.

In accordance with a further advantageous embodiment, at least one deflection roller has a bale surface with increased roughness. This can improve the control effect of the respective deflection roller on the strip run.

In accordance with a further advantageous embodiment, at least one deflection roller has a wear-resistant bale coating. For example, the bale coating can be a ceramic coating, such as a tungsten carbide coating.

In accordance with a further advantageous embodiment, the sensing apparatus is arranged and designed in such a manner as to sense an entry-side actual position of the hot-rolled strip or an exit-side actual position of the hot-rolled strip. An entry-side actual position of the hot-rolled strip is to be understood as an actual position of the hot-rolled strip before the hot-rolled strip entering the flatness-measuring device comes into contact with the entry-side deflection roller. An exit-side actual position of the hot-rolled strip means an actual position of the hot-rolled strip after the hot-rolled strip leaving the flatness-measuring device has been deflected by means of the exit-side deflection roller.

A hot-rolling mill has at least one flatness-measuring device according to one of the above embodiments or a combination of at least two of such embodiments with one another. The advantages specified above with reference to the flatness-measuring device are correspondingly associated with the hot-rolling mill.

In accordance with a method for operating a flatness-measuring device for measuring the flatness of a hot-rolled strip within a hot-rolling mill, wherein the flatness-measuring device has at least one entry-side deflection roller for contacting a first large side of the hot-rolled strip, at least one exit-side deflection roller for contacting the first large side of the hot-rolled strip, and at least one central deflection roller, which is arranged between the entry-side deflection roller and the exit-side deflection roller with respect to a strip running direction of the hot-rolled strip, can be placed against a second large side of the hot-rolled strip opposite from the first large side of the hot-rolled strip and is used as a flatness-measuring roller, an actual position of the hot-rolled strip is sensed and an angle between a longitudinal central axis of at least one deflection roller and a longitudinal axis of the flatness-measuring device running transversely to the deflection rollers is varied in accordance with a deviation of the actual position of the hot-rolled strip from a predefined target position of the hot-rolled strip.

The advantages specified above with reference to the flatness-measuring device are correspondingly associated with the method. In particular, the flatness-measuring device can be used according to any of the above embodiments or a combination of at least two of such embodiments with one another to carry out the method.

In accordance with an advantageous embodiment, an actual position of the deflection roller, the position of which can be varied accordingly, is determined, a target position of such deflection roller is determined from the deviation of the actual position of the hot-rolled strip from the predefined target position of the hot-rolled strip, and a target adjustment speed value for adjusting the angle between the longitudinal central axis of such deflection roller and the longitudinal axis of the flatness-measuring device is determined in accordance with a deviation of the actual position of such deflection roller from the target position of such deflection roller. With this embodiment, the advantages specified above with reference to the corresponding embodiment of the flatness-measuring device are correspondingly associated.

In accordance with a further advantageous embodiment, a speed of a lateral movement of the hot-rolled strip is determined and the target adjustment speed value is determined in accordance with the speed of the lateral movement of the hot-rolled strip. With this embodiment, the advantages specified above with reference to the corresponding embodiment of the flatness-measuring device are correspondingly associated.

In accordance with a further advantageous embodiment, the deflection roller, the position of which can be varied accordingly, or at least one other deflection roller is pivoted in a plane that is arranged in a manner perpendicular to the longitudinal axis of the flatness-measuring device, wherein the pivoting of the respective deflection roller in the plane is carried out in accordance with an angular value by which the angle between the longitudinal central axis of the respective deflection roller and the longitudinal axis of the flatness-measuring device can be varied. With this embodiment, the advantages specified above with reference to the corresponding embodiment of the flatness-measuring device are correspondingly associated.

In the following, the invention is explained by way of example with reference to the accompanying figures by way of preferred embodiments, wherein the features explained below can represent an advantageous or further developing aspect of the invention both in each case individually and in combination of at least two of such features with one another.

DETAILED DESCRIPTION

In the figures, identical or functionally identical components are given the same reference signs. A repeated description of these components can be omitted.

Figure 1A:
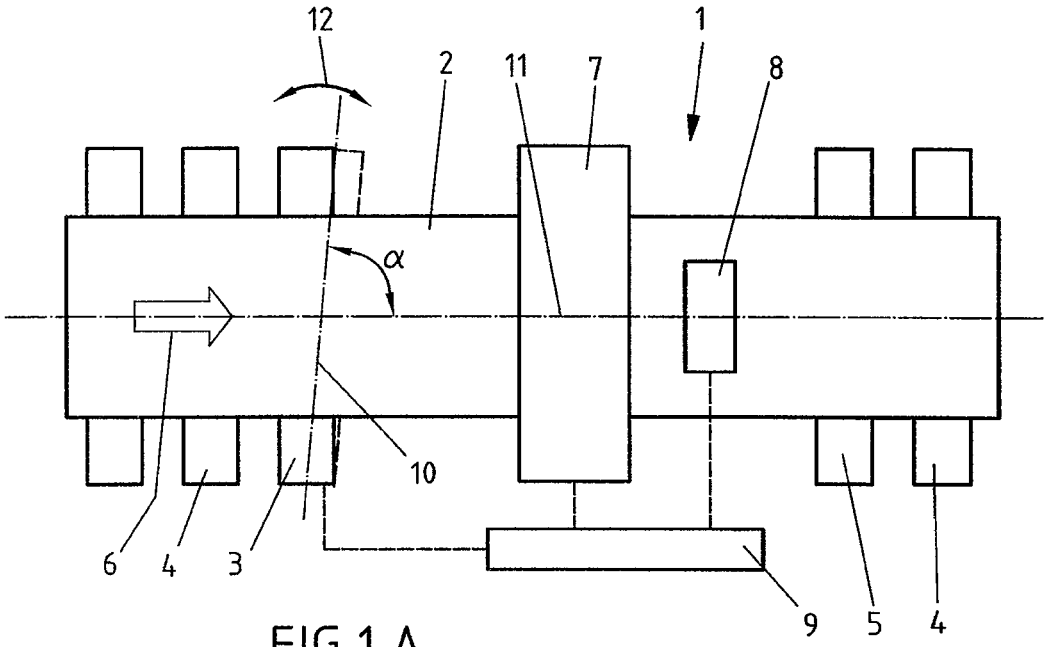
FIG. 1A is a schematic top view of an exemplary embodiment of a flatness-measuring device.

FIG. 1A shows a schematic top view of an exemplary embodiment of a flatness-measuring device 1 for measuring the flatness of a hot-rolled strip 2 within a hot-rolling mill (not shown).

The flatness-measuring device 1 has an entry-side deflection roller 3 for contacting a first large side in the form of a lower side of the hot-rolled strip 2. The entry-side deflection roller 3 is part of an entry-side roller table, of which two further guide rollers 4 are shown. The entry-side deflection roller 3 can have a bale surface with increased roughness. In addition, the entry-side deflection roller 3 can have a wear-resistant bale coating (not shown).

In addition, the flatness-measuring device 1 has an exit-side deflection roller 5 for contacting the first large side in the form of the lower side of the hot-rolled strip 2. The exit-side deflection roller 5 is part of an exit-side roller table, of which another guide roller 4 is shown. The exit-side deflection roller 5 can have a bale surface with increased roughness. In addition, the deflection roller 5 on the exit side can have a wear-resistant bale coating (not shown).

Furthermore, the flatness-measuring device 1 has a central deflection roller 7 arranged with respect to a strip running direction 6 of the hot-rolled strip 2 between the entry-side deflection roller 3 and the exit-side deflection roller 5 and adjustable against a second large side opposite from the first large side of the hot-rolled strip 2 in the form of an upper side of the hot-rolled strip 2. The central deflection roller 7 is used as a flatness-measuring roller and can have a bale surface with increased roughness. In addition, the central deflection roller 7 can have a wear-resistant bale coating (not shown).

In addition, the flatness-measuring device 1 has a sensing apparatus 8 for sensing an actual position of the hot-rolled strip 2. The sensing apparatus 8 can have at least one optical sensor (not shown), for example a camera.

The flatness-measuring device 1 also has an adjusting apparatus 9 connected to the sensing apparatus 8, the entry-side deflection roller 3 and the central deflection roller 7. The adjusting apparatus 9 is designed to vary an angle $\alpha$ between a longitudinal central axis 10 of the entry-side deflection roller 3 and a longitudinal axis 11 of the flatness-measuring device 1 running transversely to the deflection rollers 3, 5 and 7 in accordance with a deviation of the actual position of the hot-rolled strip 2 from a predefined target position of the hot-rolled strip 2. For explanatory purposes, the entry-side deflection roller 3 is shown in two pivot positions, once in solid lines and once in dashed lines, wherein the horizontal pivot capability of the entry-side deflection roller 3 is indicated by a double arrow 12. For this purpose, the entry-side deflection roller 3 is arranged so as to be displaceable about an axis of rotation, which is not shown and runs perpendicular to a strip section of the hot-rolled strip 2 fed to the entry-side deflection roller 3 and perpendicular to the drawing plane, wherein the axis of rotation is arranged in a manner offset to the center of the entry-side deflection roller 3 with respect to the longitudinal axis 10 of the entry-side deflection roller 3. The adjusting apparatus 9 has an electromechanical drive (not shown) connected to the entry-side deflection roller 3 or a hydraulic adjusting cylinder connected to the entry-side deflection roller 3.

The adjusting apparatus 9 is designed to determine an actual position of the entry-side deflection roller 3, determine a target position of the entry-side deflection roller 3 from the deviation of the actual position of the hot-rolled strip 2 from the predefined target position of the hot-rolled strip 2 and determine a target adjustment speed value for adjusting the angle $\alpha$ between the longitudinal central axis 10 of the entry-side deflection roller 3 and the longitudinal axis 11 of the flatness-measuring device 1 in accordance with a deviation of the actual position of the entry-side deflection roller 3 from the target position of the entry-side deflection roller 3. In addition, the adjusting apparatus 9 is designed to determine a speed of a lateral movement of the hot-rolled strip 2 and to determine the target adjustment speed value in accordance with the speed of the lateral movement of the hot-rolled strip 2.

The adjusting apparatus 9 is further designed to pivot the central deflection roller 7 in a plane perpendicular to the longitudinal axis 11 of the flatness-measuring device 1 and perpendicular to the drawing plane. Furthermore, the adjusting apparatus 9 is designed to carry out the pivoting of the central deflection roller 7 in the plane in accordance with an angular value by which the angle $\alpha$ between the longitudinal central axis 10 of the entry-side deflection roller 3 and the longitudinal axis 11 of the flatness-measuring device 1 can be varied by means of the adjusting apparatus 9.

The flatness-measuring device 1 can have a holding frame (not shown) and on which the entry-side deflection roller 3, the exit-side deflection roller 5 and/or the central deflection roller 7 are or is, as the case may be, rotatably mounted, wherein the adjusting apparatus 9 is connected via the holding frame to the respective deflection rollers 3, 5 or 7 and the deflection rollers 3, 5 or 7 and the holding frame is displaceable together with the deflection rollers 3, 5 or 7 connected thereto.

Figure 1B:
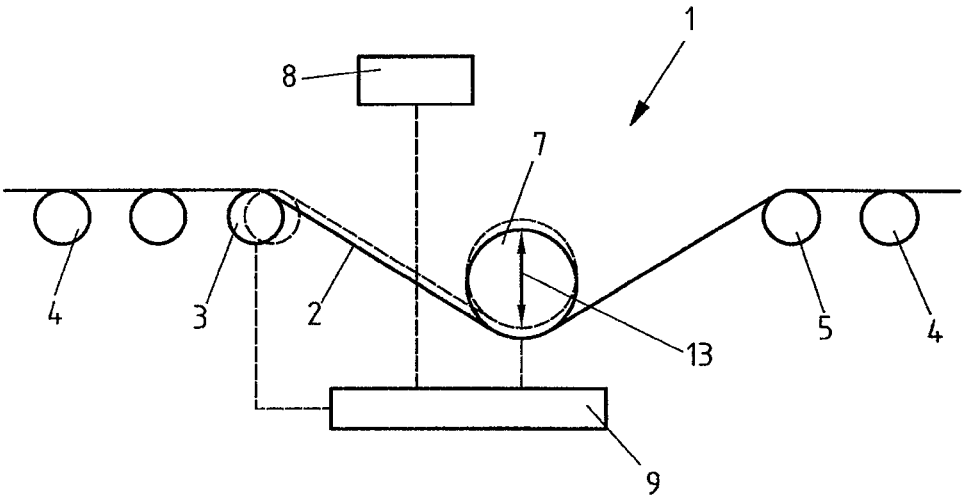
FIG. 1B is a schematic side view of the flatness-measuring device shown in FIG. 1A.

FIG. 1B shows a schematic side view of the flatness-measuring device 1 shown in FIG. 1A. The vertical pivot capability of the center deflection roller 7 is shown, once in solid lines and once in dashed lines, wherein the vertical pivot capability of the center deflection roller 7 is indicated by a double arrow 13.

Figure 2:
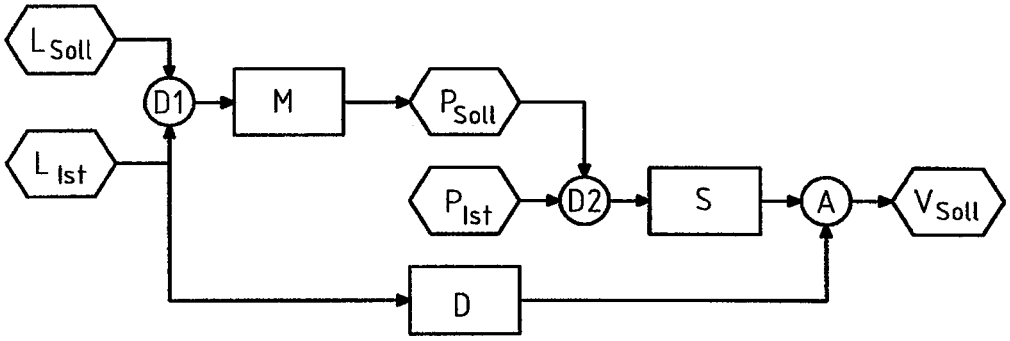
FIG. 2 is a flow chart of an exemplary embodiment of a method for operating a flatness-measuring device.

FIG. 2 shows a flow chart of an exemplary embodiment of a method for operating a flatness-measuring device for measuring the flatness of a hot-rolled strip within a hot-rolling mill. The flatness-measuring device can be formed according to the exemplary embodiment shown in FIGS. 1A and 1B.

First, an actual position $L_{Ist}$ of the hot-rolled strip is sensed. A difference is formed from the actual position $L_{Ist}$ and a predefined target position $L_{Soll}$ of the hot-rolled strip by means of a subtracting element D1 of the adjusting apparatus, which is fed to a center controller M of the adjusting apparatus of the flatness-measuring device. In accordance with the difference, the center controller M generates a target position $P_{Soll}$ of the deflection roller connected to the adjusting apparatus, which optimizes the strip run of the hot-rolled strip. In addition, an actual position $P_{Ist}$ of the deflection roller connected to the adjusting apparatus is sensed. The actual position $P_{Ist}$ of the deflection roller and the target position $P_{Soll}$ of the deflection roller are used to form a further difference by means of a further subtracting element D2 of the adjusting apparatus, which is fed to a pivot controller S of the adjusting apparatus of the flatness-measuring device. The pivot controller S generates an adjustment speed value in accordance with the difference D2 for adjusting the angle between the longitudinal central axis of the deflection roller connected to the adjusting apparatus and the longitudinal axis of the flatness-measuring device. The difference generated by means of the subtracting element D1 is also fed to a differential controller D of the adjusting apparatus, which determines a speed of a lateral movement of the hot-rolled strip and uses such speed to determine an additional value for the adjustment speed. The adjustment speed value generated by the pivot controller S and the additional value generated by the differential controller D are added by means of an adding element A of the adjusting apparatus, resulting in a target position adjustment speed value $V_{Soll}$, which can be used to control actuators of the adjusting apparatus.

Consequently, in accordance with the method, an angle between a longitudinal central axis of the deflection roller connected to the adjusting apparatus and a longitudinal axis of the flatness-measuring device running transversely to the deflection rollers is varied in accordance with a deviation of the actual position $L_{Ist}$ of the hot-rolled strip from a predefined target position $L_{Soll}$ of the hot-rolled strip. Thereby, in accordance with the method, an actual position $P_{Ist}$ of the deflection roller connected to the adjusting apparatus, the position of which can be varied accordingly, is determined, a target position $P_{Soll}$ of the deflection roller connected to the adjusting apparatus is determined from the deviation of the actual position $L_{Ist}$ of the hot-rolled strip from the predefined target position $L_{Soll}$ of the hot-rolled strip, and a target adjustment speed additional value for adjusting the angle between the longitudinal central axis of the deflection roller connected to the adjusting apparatus and the longitudinal axis of the flatness-measuring device is determined in accordance with a deviation of the actual position $P_{Ist}$ of such deflection roller from the target position $P_{Soll}$ of such deflection roller. In addition, in accordance with the method, a speed of a lateral movement of the hot-rolled strip is determined and the target adjustment speed additional value is determined in accordance with the speed of the lateral movement of the hot-rolled strip.

In order to compensate for a change in the geometry of the clamping of the hot-rolled strip in the flatness-measuring device caused by an adjustment of the deflection roller connected to the adjusting apparatus, the deflection roller, the position of which can be varied accordingly, or another deflection roller of the flatness-measuring device can be pivoted in a plane that is arranged in a manner perpendicular to the longitudinal axis of the flatness-measuring device. The pivoting of such deflection roller in the plane can be carried out in accordance with an angular value by which the angle between the longitudinal central axis of the deflection roller, the pivoting of which has caused the change in geometry, and the longitudinal axis of the flatness-measuring device can be varied.

LIST OF REFERENCE SIGNS

1 Flatness-measuring device
2 Hot-rolled strip
3 Entry-side deflection roller
4 Guide roller
5 Exit-side deflection roller
6 Strip running direction
7 Central deflection roller
8 Sensing apparatus
9 Adjusting apparatus
10 Longitudinal central axis of 3
11 Longitudinal axis from 1
12 Double arrow (pivot capability of 3)
13 Double arrow (pivot capability of 7)
A Adding element
D Differential controller
D1 Subtracting element
D2 Subtracting element
$L_{Ist}$ Actual position of 2
$L_{Soll}$ Target position of 2
M Center controller
$P_{Ist}$ Actual position of 3, 5, 7
$P_{Soll}$ Target position of 3, 5, 7
S Pivot controller
$V_{Soll}$ Target position speed value
$\alpha$ Angle between 10 and 11

The invention claimed is:

1. A flatness-measuring device (1) for measuring flatness of a hot-rolled strip (2) within a hot-rolling mill, comprising:
deflection rollers (3, 5, 7), including
an entry-side deflection roller (3) for contacting a first large side of the hot-rolled strip (2),
an exit-side deflection roller (5) for contacting the first large side of the hot-rolled strip (2), and
a central deflection roller (7) arranged between the entry-side deflection roller (3) and the exit-side deflection roller (5) with respect to a strip running direction (6) of the hot-rolled strip (2),
wherein the central deflection roller (7) is placed against a second large side of the hot-rolled strip (2) opposite from the first large side of the hot-rolled strip (2), and
wherein the central deflection roller (7) is used as a flatness-measuring roller;
a sensing apparatus (8) for sensing an actual position ($L_{Ist}$) of the hot-rolled strip (2); and
an adjusting apparatus (9),
wherein the adjusting apparatus (9) is connected to the sensing apparatus (8) and to one of the deflection rollers (3, 5, 7), and
wherein the adjusting apparatus (9) is designed to vary an angle ($\alpha$) between a longitudinal central axis (10) of the one of the deflection rollers (3, 5, 7) connected to the adjusting apparatus (9) and a longitudinal axis (11) of the flatness-measuring device (1) running transversely to the deflection rollers (3, 5, 7) based on a deviation of the actual position ($L_{Ist}$) of the hot-rolled strip (2) from a predefined target position ($L_{Soll}$) of the hot-rolled strip (2).

2. The flatness-measuring device (1) according to claim 1, wherein the adjusting apparatus (9) is designed
to determine an actual position ($P_{Ist}$) of the one of the deflection rollers (3, 5, 7) connected to the adjusting apparatus (9),
to determine a target position ($P_{Soll}$) of the one of the deflection rollers (3, 5, 7) from the deviation of the actual position ($L_{Ist}$) of the hot-rolled strip (2) from the predefined target position ($L_{Soll}$) of the hot-rolled strip (2), and to determine a target adjustment speed value ($V_{Soll}$) for adjusting the angle ($\alpha$) based on a deviation of the actual position ($P_{Ist}$) of the one of the deflection rollers (3, 5, 7) from the target position ($P_{Soll}$) of the one of the deflection rollers (3, 5, 7).

3. The flatness-measuring device (1) according to claim 2, wherein the adjusting apparatus (9) is designed to determine a speed of a lateral movement of the hot-rolled strip (2) and to determine the target adjustment speed value ($V_{Soll}$) based on the speed of the lateral movement of the hot-rolled strip (2).

4. The flatness-measuring device (1) according to claim 1, wherein the adjusting apparatus (9) is designed to pivot the one of the deflection rollers (3, 5, 7) connected to the adjusting apparatus (9) and/or another of the deflection rollers (3, 5, 7) in a plane perpendicular to the longitudinal axis (11) of the flatness-measuring device (1).

5. The flatness-measuring device (1) according to claim 1, wherein the one of the deflection rollers (3, 5, 7) connected to the adjusting apparatus (9) is arranged displaceably about an axis of rotation running perpendicularly to a strip section of the hot-rolled strip (2) that is fed to the one of the deflection rollers (3, 5, 7), wherein the axis of rotation is arranged through a center of the one of the deflection rollers (3, 5, 7) or offset to the longitudinal axis (10) of the one of the deflection rollers (3, 5, 7) from the center of the one of the deflection rollers (3, 5, 7).

6. The flatness-measuring device (1) according to claim 1, further comprising an electromechanical drive connected to the one of the deflection rollers (3, 5, 7) connected to the adjusting apparatus (9), or a hydraulic actuating cylinder connected to the one of the deflection rollers (3, 5, 7).

7. The flatness-measuring device (1) according to claim 1, further comprising a holding frame on which the entry-side deflection roller (3), the exit-side deflection roller (5), and/or the central deflection roller (7) are or is rotatably mounted, wherein the adjusting apparatus (9) is connected to the one of the deflection rollers (3, 5, 7) via the holding frame and the holding frame is displaceable together with the one of the deflection rollers (3, 5, 7) connected thereto.

8. The flatness-measuring device (1) according to claim 1, wherein at least one of the deflection rollers (3, 5, 7) has a bale surface with increased roughness relative to another of the deflection rollers (3, 5, 7).

9. The flatness-measuring device (1) according to claim 1, wherein at least one of the deflection rollers (3, 5, 7) has a wear-resistant bale coating.

10. The flatness-measuring device (1) according to claim 1, wherein the sensing apparatus (8) is arranged and designed in such a manner as to sense an entry-side actual position ($L_{Ist}$) of the hot-rolled strip (2) or an exit-side actual position ($L_{Ist}$) of the hot-rolled strip (2).

11. The hot-rolling mill comprising the flatness-measuring device (1) according to claim 1.

12. A method for operating a flatness-measuring device (1) for measuring flatness of a hot-rolled strip (2) within a hot-rolling mill, wherein the flatness-measuring device (1) has deflection rollers (3, 5, 7), including an entry-side deflection roller (3) for contacting a first large side of the hot-rolled strip (2), an exit-side deflection roller (5) for contacting the first large side of the hot-rolled strip (2), and a central deflection roller (7), which is arranged between the entry-side deflection roller (3) and the exit-side deflection roller (5) with respect to a strip running direction (6) of the hot-rolled strip (2), wherein the central deflection roller (7) is placed against a second large side of the hot-rolled strip (2) opposite from the first large side of the hot-rolled strip (2), and wherein the central deflection roller (7) is used as a flatness-measuring roller, the method comprising:

sensing an actual position ($L_{Ist}$) of the hot-rolled strip (2); and varying an angle ($\alpha$) between a longitudinal central axis (10) of one of the deflection rollers (3, 5, 7) and a longitudinal axis (11) of the flatness-measuring device (1) based on a deviation of the actual position ($L_{Ist}$) of the hot-rolled strip (2) from a predefined target position ($L_{Soll}$) of the hot-rolled strip (2).

13. The method according to claim 12, further comprising:

determining an actual position ($P_{Ist}$) of the one of the deflection rollers (3, 5, 7);

determining a target position ($P_{Soll}$) of the one of the deflection rollers (3, 5, 7) from the deviation of the actual position ($L_{Ist}$) of the hot-rolled strip (2) from the predefined target position ($L_{Soll}$) of the hot-rolled strip (2); and determining a target adjustment speed value ($V_{Soll}$) for adjusting the angle ($\alpha$) based on a deviation of the actual position ($P_{Ist}$) of the one of the deflection rollers (3, 5, 7) from the target position ($P_{Soll}$) of the one of the deflection rollers (3, 5, 7).

14. The method according to claim 13, further comprising:

determining a speed of a lateral movement of the hot-rolled strip (2); and determining the target adjustment speed value ($V_{Soll}$) based on the speed of the lateral movement of the hot-rolled strip (2).

15. The method according to claim 12, further comprising:

pivoting the one of the deflection rollers (3, 5, 7) and/or another one of the deflection rollers (3, 5, 7) in a plane is-perpendicular to the longitudinal axis (11) of the flatness-measuring device (1).

* * * * *